US005740964A

United States Patent [19]

Crampton

[11] Patent Number: 5,740,964

[45] Date of Patent: Apr. 21, 1998

[54] HAND HELD SPRAY DISPENSER WITH ADJUSTABLE PRESSURE DELIVERY SYSTEM AND ROTATING NOZZLE

[75] Inventor: David Crampton, Fountain Valley, Calif.

[73] Assignee: Par-Way Group, St. Clair, Mo.

[21] Appl. No.: 528,444

[22] Filed: Sep. 14, 1995

Related U.S. Application Data

[63] Continuation-in-part of Ser. No. 440,324, May 12, 1995, Pat. No. 5,667,138, which is a continuation-in-part of Ser. No. 243,366, May 16, 1995, Pat. No. 5,492,275.

[51] Int. Cl.[6] ..... B05B 9/043

[52] U.S. Cl. ..... 239/333; 239/533.1; 239/569

[58] Field of Search ..... 239/333, 331, 239/329, 533.1, 569; 222/383.1, 321.2, 321.8, 341

[56] References Cited

U.S. PATENT DOCUMENTS

| | | | |
|---|---|---|---|
| 3,701,478 | 10/1972 | Tada | 239/333 |
| 3,762,647 | 10/1973 | Tada | 239/464 X |
| 3,896,975 | 7/1975 | Follmer | 222/192 |
| 3,913,841 | 10/1975 | Tada | 239/324 |
| 3,927,834 | 12/1975 | Tada | 239/359 |
| 4,059,228 | 11/1977 | Werner | 239/106 |
| 4,365,751 | 12/1982 | Saito et al. | 239/333 |
| 4,646,969 | 3/1987 | Sorm et al. | 239/106 |
| 4,735,362 | 4/1988 | Trautwein | 239/127 |
| 4,838,490 | 6/1989 | Nissels | 239/333 |
| 5,016,687 | 5/1991 | Kawamura | 141/116 |
| 5,088,649 | 2/1992 | Hanson et al. | 239/329 |
| 5,152,425 | 10/1992 | Baudin | 222/1 |
| 5,156,304 | 10/1992 | Battegazzore | 222/341 |
| 5,358,179 | 10/1994 | Lund et al. | 239/333 |

*Primary Examiner*—Lesley D. Morris
*Attorney, Agent, or Firm*—James A. Quinton

[57] ABSTRACT

A manual spray dispenser for pressurizing a liquid to a predetermined pressure is provided. The spray dispenser includes a pressure adjustment assembly to adjust the predetermined pressure between a preselected range of pressures. The pressure adjustment assembly includes an adjustable biasing member to supply a force to a pressure chamber check valve in a direction opposite the flow of liquid from the reservoir to the atmosphere so that the pressure in the delivery passageway can be varied. Optionally, a two-hole rotating nozzle is provided in combination with a pressure adjustment assembly. In another aspect of the invention, an exit orifice purge system is provided to reduce dripping from the nozzle in the manual sprayer after dispensing.

12 Claims, 14 Drawing Sheets

HAND HELD SPRAY DISPENSER WITH ADJUSTABLE PRESSURE DELIVERY SYSTEM AND ROTATING NOZZLE

This is a continuation-in-part of Ser. No. 440,324, filed May 12, 1995, now U.S. Pat. No. 5,667,138 which is a continuation in part of Ser. No. 243,366, filed May 16, 1995 now U.S. Pat. No. 5,492,275.

BACKGROUND OF THE INVENTION

1. Field of the Invention

The present invention relates to improvements in manually operated spray dispensers particularly in hand pump dispensers.

2. Description of the Prior Art

Aerosol containers have been in widespread use for dispensing of a variety of products. These dispensers have been of particular value in dispensing viscous liquids. Commonly, a hydrocarbon propellant has been used with viscous products particularly viscous hydrocarbon based products. Under pressure in an aerosol container, hydrocarbon propellant serves as a diluent and thus reduces the viscosity and surface tension of the viscous liquid. See for example U.S. Pat. No. 3,896,975. Efforts are now under way to eliminate hydrocarbon propellants from the environment. Freon has already been banned, out of concern for the ozone layer. Other hydrocarbons such as isobutane and propane and other volatile organic compounds (VOCS) have been identified as contributing factors in air pollution in urban areas. Thus, such propellants are undesirable and need to be removed from the spray containers.

Hand pump sprayers of the trigger type are known in the art. See U.S. Pat. Nos. 3,701,478 3,927,834 and 4,646,969 and U.S. Pat. No. 5,088,649.

Pump sprayable dispensing systems for viscous liquids have been developed in the prior art. For example, U.S. Pat. No. 5,088,649 describes a hand pump sprayer which can dispense a fine spray of viscous liquid without the need of using hydrocarbon propellants or other diluents. The fluid delivered by the hand pump sprayer of the '649 patent exits from the nozzle in two streams which collide at a point exterior to the nozzle assembly. The resulting spray pattern of such a sprayer is fan shaped. However, there are some applications where a fan shaped pattern is inconvenient.

Sprayers which have nozzles which can be rotated about their delivery passageway to allow the user to select different predetermined shaped nozzle holes are known. See U.S. Pat. No. 4,838,490. Pump sprayers which allow the movement of the nozzle outlet between two extreme positions during dispensing of the fluid are knowing in the art. See U.S. Pat. No. 5,152,425.

SUMMARY OF THE INVENTION

The present invention is directed to an improved hand pump sprayer. The invention also relates to a system for dispensing viscous liquids. The hand pump sprayer according to the invention provides improved atomization and a circular spray pattern.

According to the invention a hand pump sprayer of the finger pump or trigger type is provided wherein fluid is pressurized and brought from a reservoir to the outlet of a delivery passageway upon the engagement of an activator. A nozzle having an inlet and an outlet is rotatably mounted to the hand pump sprayer. The nozzle rotates about a rotation axis through the center of discharge end of the nozzle.

Preferably the nozzle is one that provides colliding streams of fluid intersecting at a point outside the nozzle such as described in the U.S. Pat. No. 5,088,649 (Hanson). Alternatively, a nozzle having a single hole which is eccentric, that is, off center from the axis of rotation of the nozzle is provided. The activator of the hand pump sprayer is interconnected to the rotatably mounted nozzle to provide rotation of the nozzle simultaneously with the dispensing of the liquid from the reservoir to the atmosphere. The nozzle rotates from about 90° to 360° about the axis of rotation, most preferably from 180° to 360°. The resulting hand pump sprayer is capable of dispensing viscous liquids having a viscosity over 60 cps and delivering a desirable round spray pattern. In addition, the spray pump of the invention provides increased atomization and misting over that of a conventional sprayer regardless of the viscosity of the liquid pumped.

According to the invention, the pressure in the delivery passageway is adjustable over a selected range of pressures. In another aspect of the invention, dripping of liquid from the nozzle is reduced. A negative pressure is created on the nozzle outlets after the liquid has been dispensed to the atmosphere to draw any unsprayed liquid from the nozzle outlets back into the delivery passageway.

It is an object of the invention to provide a hand pump sprayer which gives improved atomization of the delivered liquid.

It is an object of the invention to provide a hand pump sprayer which can dispense viscous products having a viscosity of 60 cps or greater in fine droplets.

It is an object of the invention to provide a hand pump sprayer that can deliver liquid to the atmosphere over a range of preselected pressures.

It is an object of the invention to provide a hand pump sprayer which draws back unsprayed liquid from the nozzle outlets after each spraying stroke.

It is an object of the invention to provide a hand pump sprayer which reduces dripping from the nozzle.

It is an object of the invention to provide a hand pump sprayer which dispenses viscous products in a round spray pattern.

It is an object of the invention to provide a viscous fluid dispensing system which can readily spray viscous products having a viscosity over 60 cps in fine droplets in a round spray pattern.

It is an object of the invention to provide a hand pump sprayer with a nozzle that rotates about 180° to 360° about an axis X of rotation through the center of the nozzle outlet end as the liquid is expelled to the atmosphere.

The preferred embodiment of the present invention is illustrated in the drawings and examples. However, it should be expressly understood that the present invention should not be limited solely to the illustrative embodiment.

DETAILED DESCRIPTION OF THE INVENTION

The present invention relates to a hand pump sprayer for dispensing of a variety of different liquids. The invention also relates to a system for dispensing viscous fluids. According to the invention a hand pump sprayer has a nozzle which rotates about an axis of rotation through the center of the discharge end of the nozzle through an angle of rotation of from 90° to 360° preferably from 180° to 360° and most preferably 270° or more. The nozzle is interconnected to the actuator of a hand pump sprayer preferably a trigger or finger pump. The nozzle is rotated by engaging the trigger or finger pump. Simultaneously as pressurized fluid is delivered to the atmosphere from a reservoir of the hand pump sprayer, the nozzle rotates. The nozzle can have a variety of different discharge outlets. Preferably the nozzle has two discharge outlets which are spaced apart and provide colliding streams of fluid intersecting at a point outside the nozzle such as described in U.S. Pat. No. 5,088,649. Preferably the outlets are on opposite sides of the axis X of rotation. Optionally three or more colliding streams emanating from three or more outlets can be provided. Alternatively a single discharge outlet can be provided. In such instance the discharge outlet is eccentric to the axis of rotation of the rotating nozzle. The resulting hand pump sprayer provides superior atomization of the sprayed liquid and at the same time provides the desirable round spray pattern.

The hand pump sprayer according to the invention is particularly useful with viscous liquids having a viscosity of 60 cps or greater. Most preferably the invention is useful for pump spraying viscous liquids having a viscosity of from 60 cps to 100 cps and preferably from 60 to 85 cps and most preferably from 70 to 85 cps. A wide range of viscous products can be dispensed in a fine mist. For example, vegetable oil, vegetable oil lecithin mixtures, paint without volatile organic compounds (VOCS) diluents, e.g. paint pigments in linseed oil, viscous petroleum products, viscous lubricants, adhesives, resins, e.g. hair spray having a viscosity of 60 cps or greater are contemplated according to the invention. Preferably the hand pump sprayer according to the invention is used to pump viscous vegetable oil containing compositions, most preferably vegetable oil lecithin mixtures. Optionally, non-viscous liquids may be used in the pump sprayer according to the invention such as water or alcohol based window cleaners, household cleaners or other water based products. Such liquids are sprayed in a fine mist with superior atomization and a round spray pattern.

Figure 11:
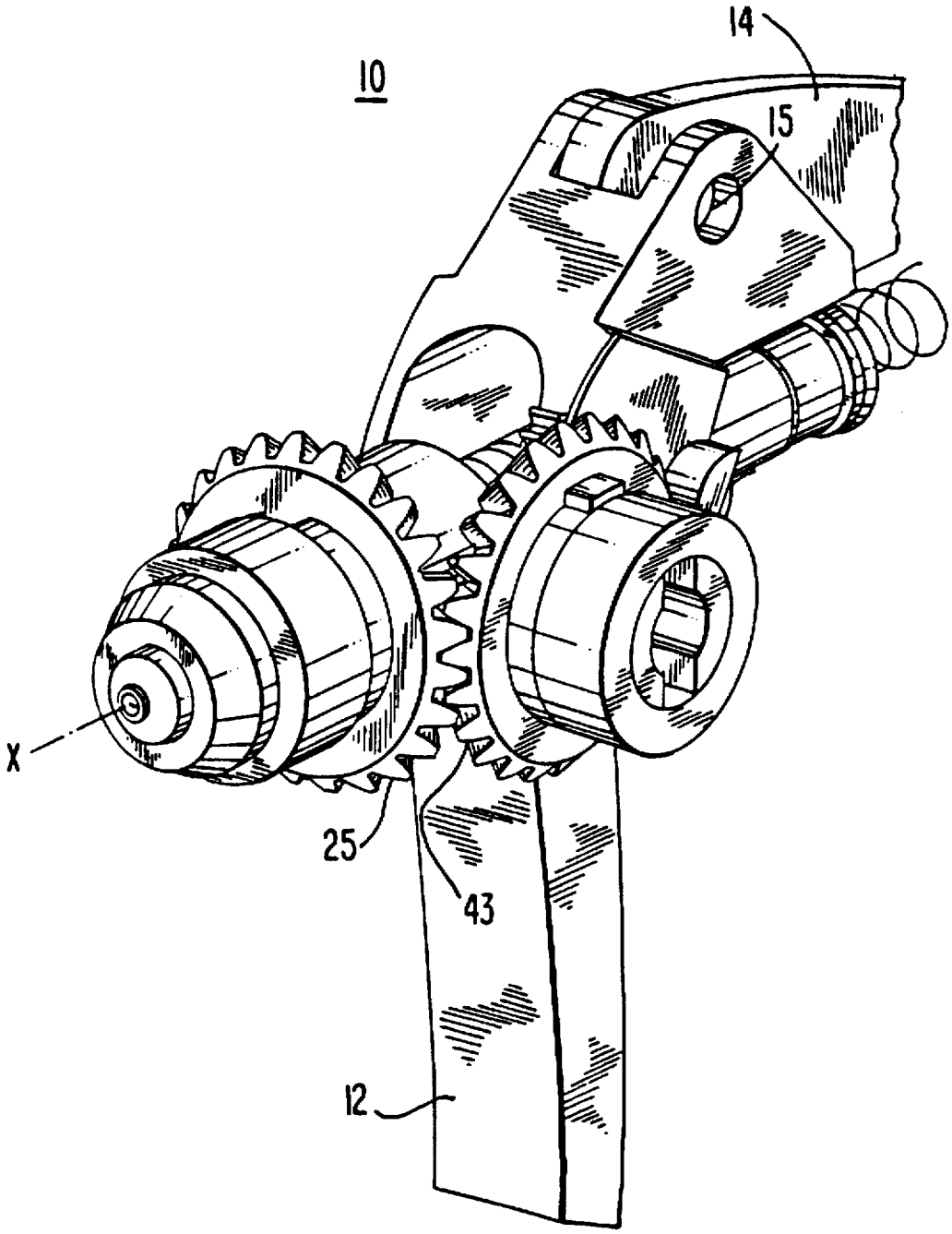
FIG. 11 is a perspective view if an alternative embodiment of the hand pump sprayer according to the invention.
Figure 12:
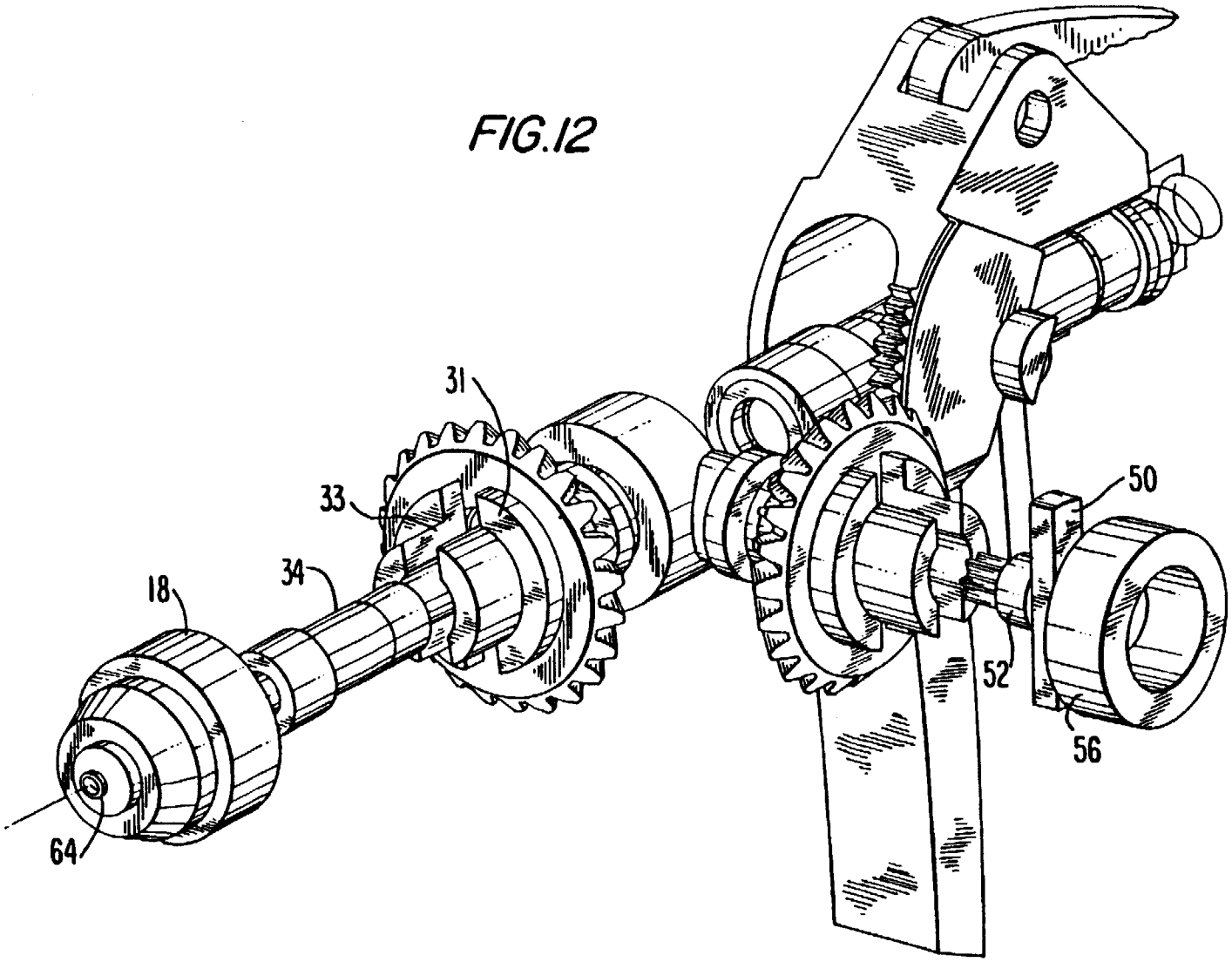
FIG. 12 is an exploded perspective view of the hand pump sprayer of FIG. 11 looking from the front right side.
Figure 13:
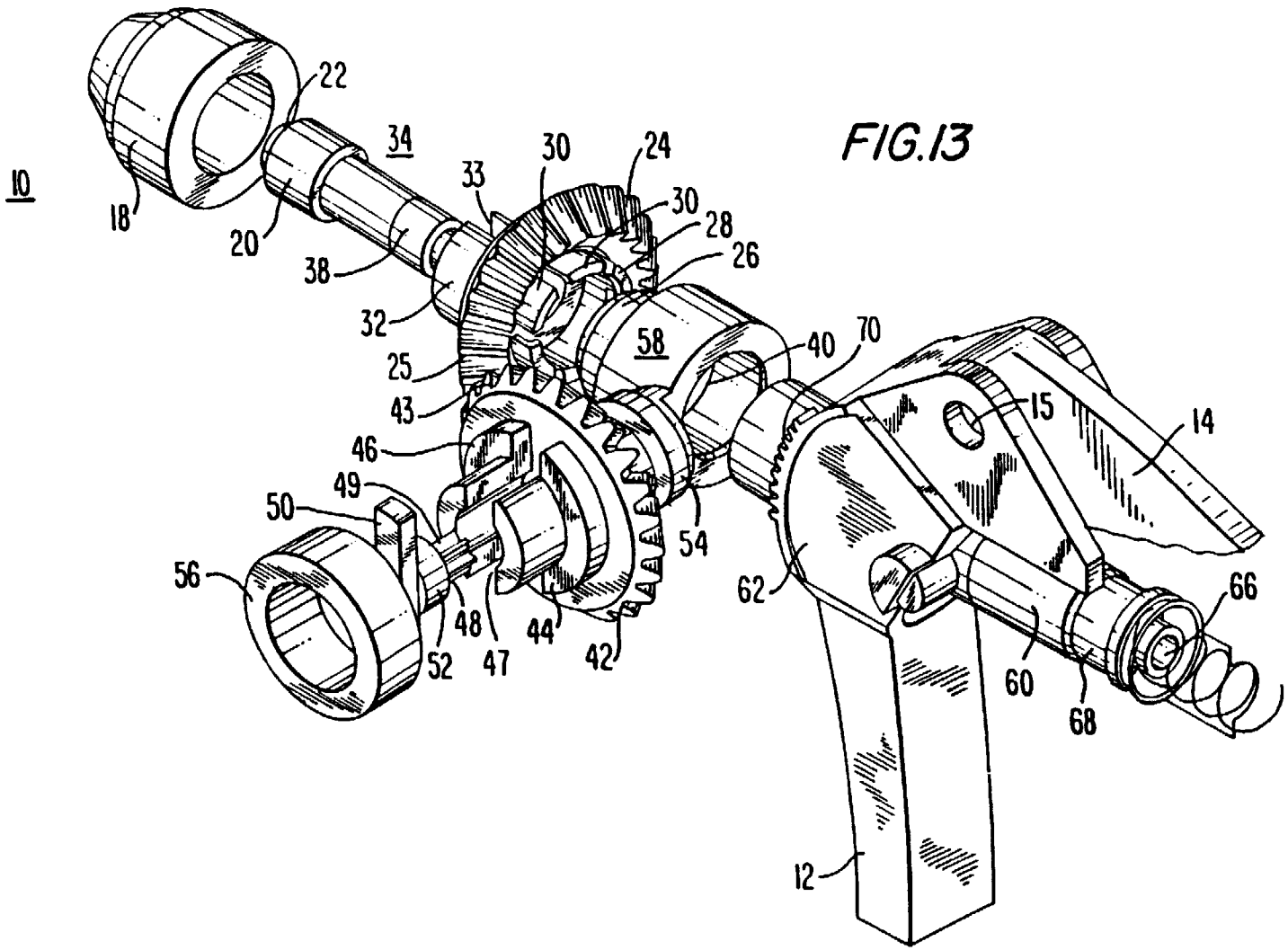
FIG. 13 is an exploded perspective view of the hand pump sprayer of FIG. 1 looking from the back left side.
Figure 16:
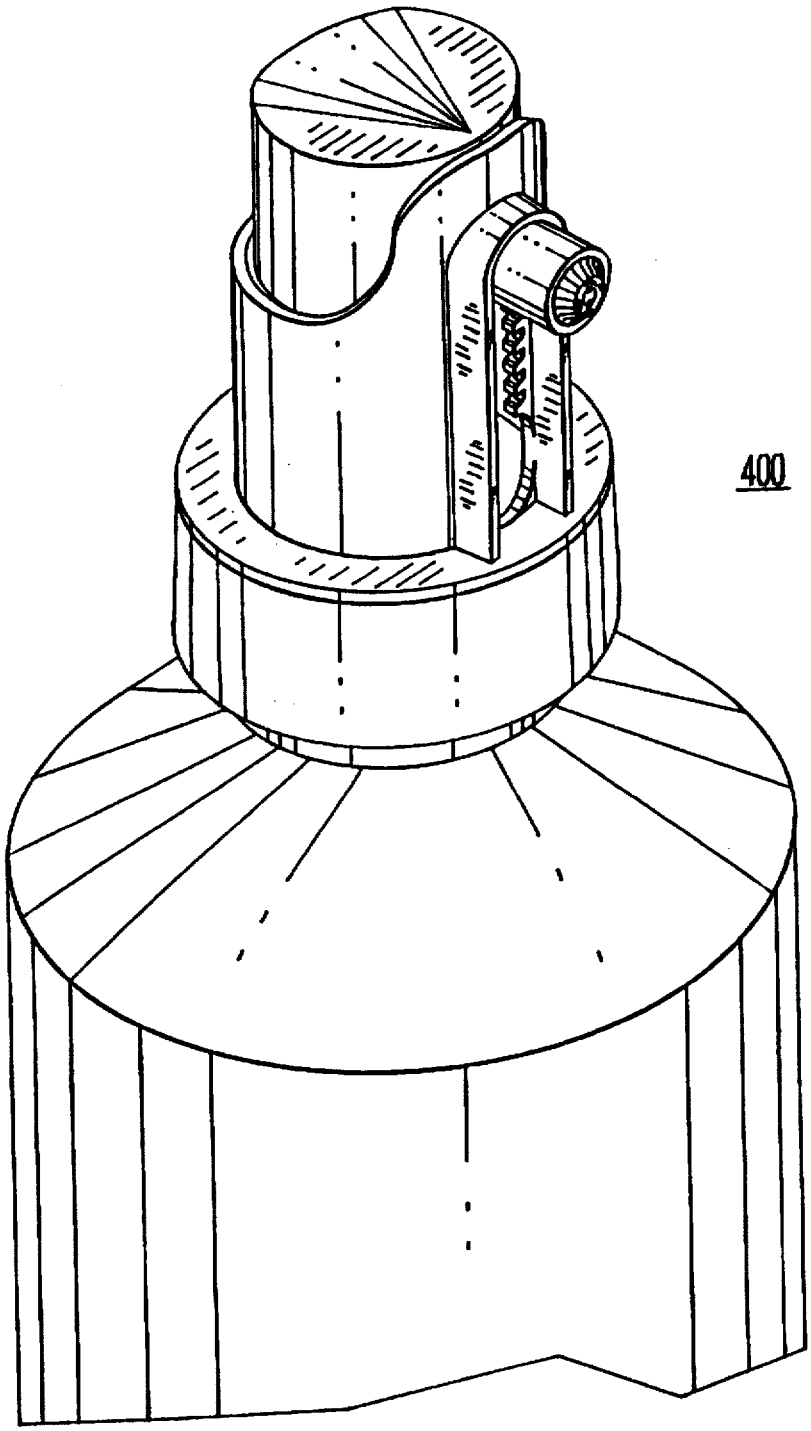
FIG. 16 is a perspective view of an alternate embodiment according to the invention.

According to the invention, a hand pump sprayer is provided which has a nozzle which rotates about an axis X through the center of the outlet end of the nozzle through an angle of rotation of from 90° to 360° preferably from 180° to 270° and most preferably over 270° simultaneously with dispensing of product from the spray pump reservoir to the atmosphere. According to the invention, a generally conventional plunger arrangement is used to draw the liquid from the reservoir of the hand pump sprayer to the delivery passageway of the hand pump sprayer. See, for example U.S. Pat. No. 4,646,969 or U.S. Pat. No. 3,927,834 which are incorporated by reference. Desirably a Continental Model 922 modified to have a rotating nozzle is useful in the invention. The liquid is drawn from the reservoir and delivered under pressure to the nozzle through a delivery passageway upon the pulling of the trigger. The nozzle is operatively driven by the action of the trigger of the hand pump sprayer. Preferably the nozzle is rotated by a nozzle drive gear which imparts rotational movement to the nozzle as the trigger is moved back and forth. There are a variety of gearing arrangements possible to translate the back and forth trigger movement to rotational movement of the nozzle. The nozzle drive gear can be directly driven by a rack attached to trigger as shown in FIGS. 1 to 10. In such instance the nozzle drive gear will in fact be a pinion interacting directly with a gear rack attached to the trigger. Alternatively as shown in FIGS. 11 to 13, the nozzle drive gear can be driven indirectly by the trigger through several gears which are ultimately operated by the back and forth movement of the trigger. Alternatively, as shown in FIG. 16, the hand pump sprayer may be a finger pump instead of a trigger sprayer.

Figure 1:
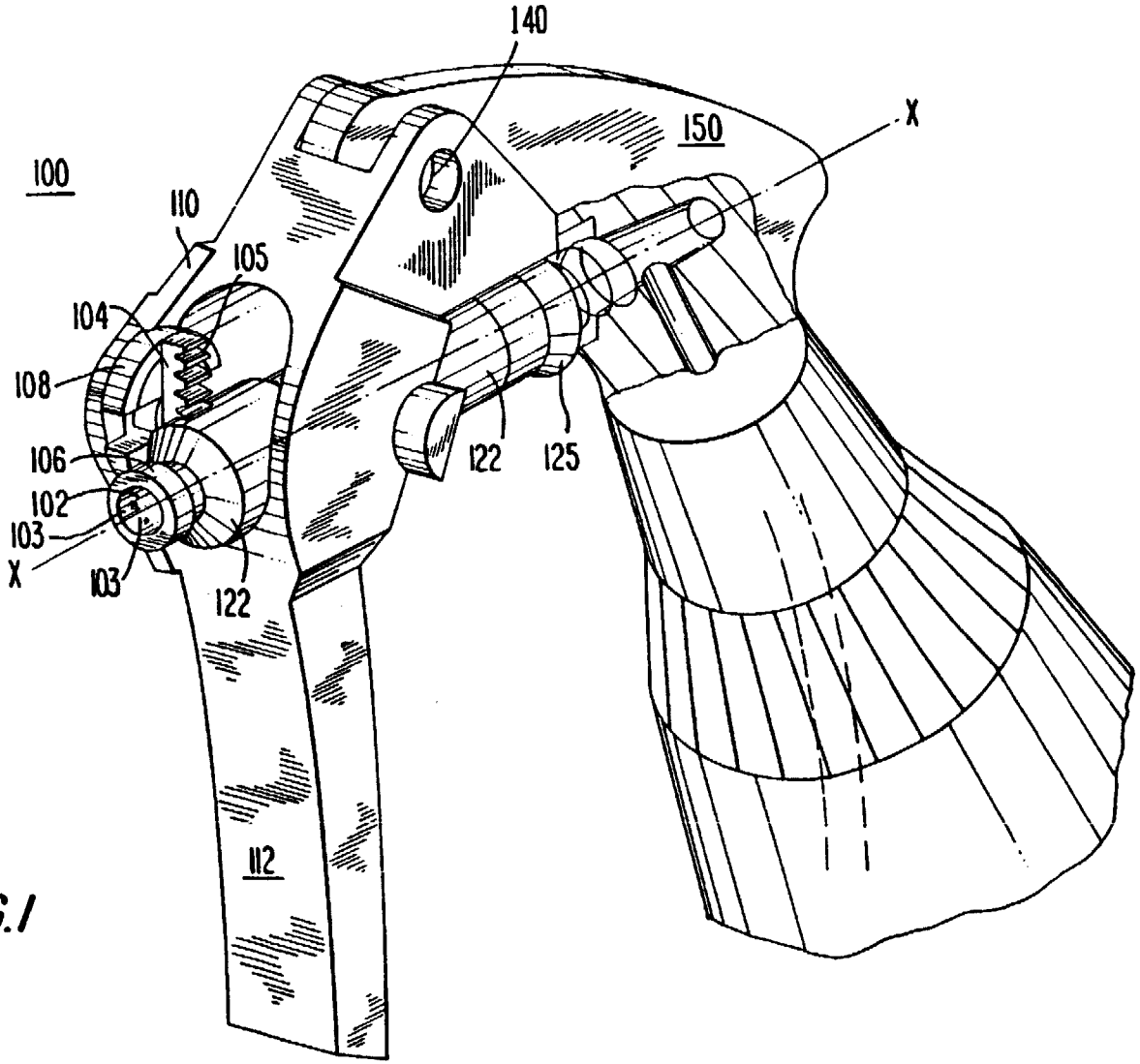
FIG. 1 is a perspective of the hand pump sprayer according to the invention.
Figure 2:
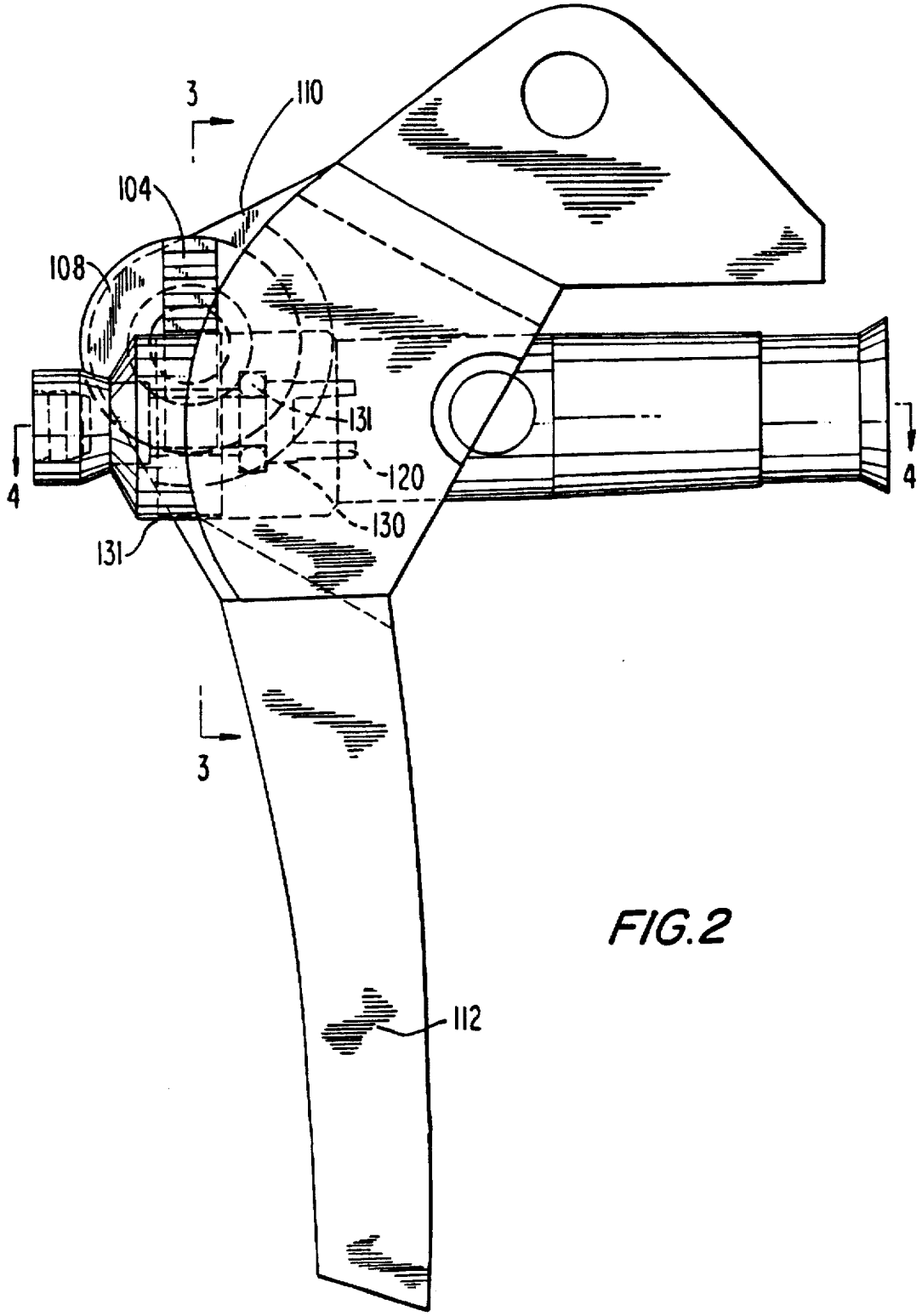
FIG. 2 is a side view of FIG. 1.
Figure 3:
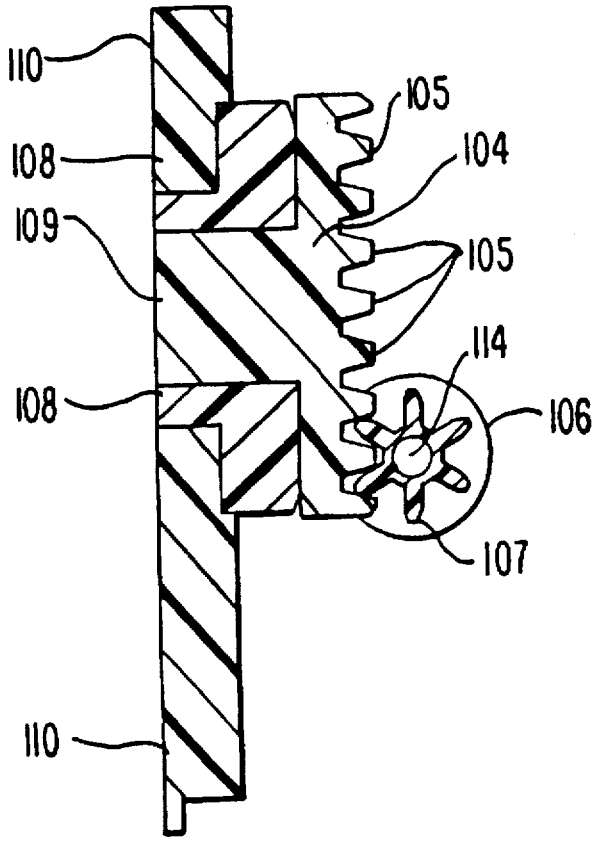
FIG. 3 is a partial sectional view through 3—3 of FIG. 2 to show the arrangement of the rack and pinion with the pinion retainer removed.
Figure 4:
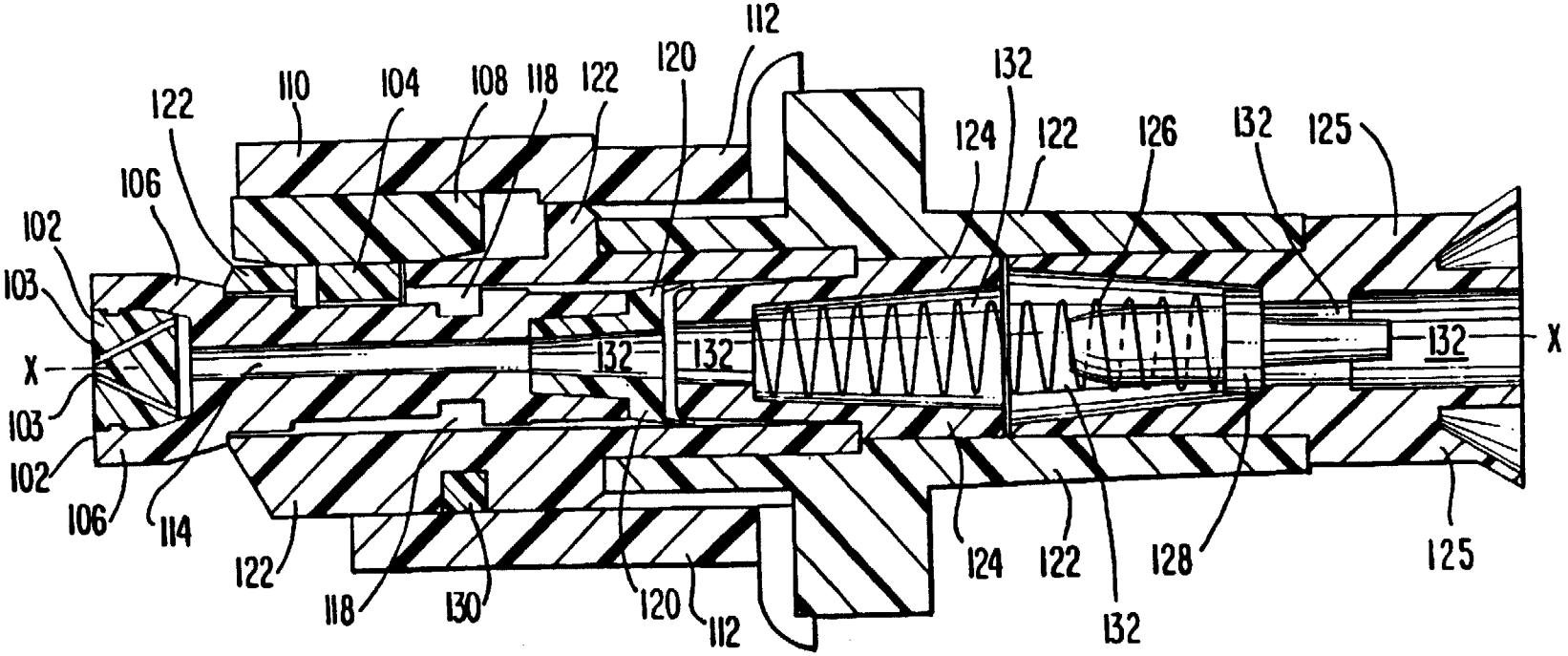
FIG. 4 is a sectional view through 4—4 of FIG. 2.
Figure 5A:
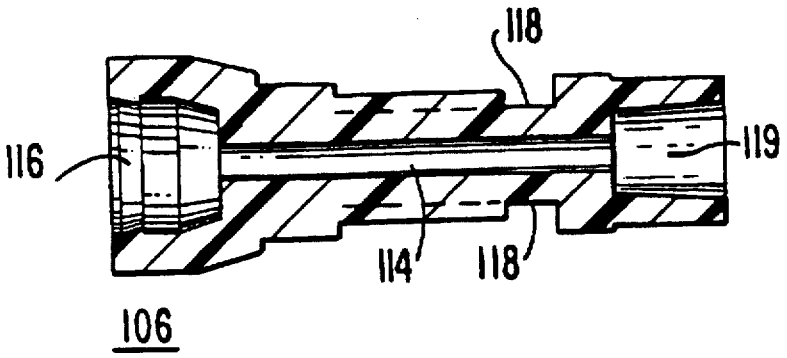
FIG. 5A is a sectional top view of the pinion assembly through 5A—5A of FIG. 5.
Figure 5:
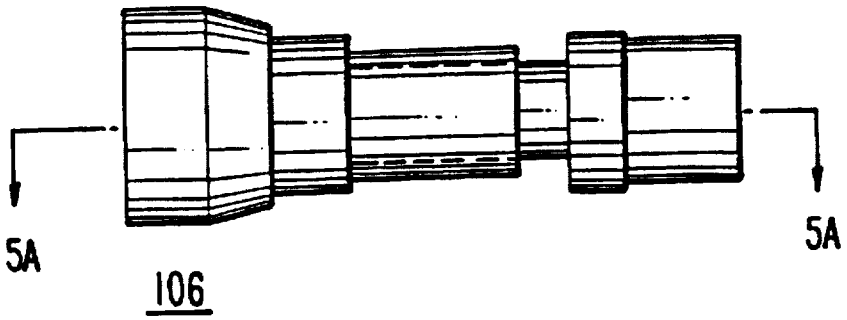
FIG. 5 is a side view of the pinion assembly used in the hand pump sprayer of FIG. 1.
Figure 6:
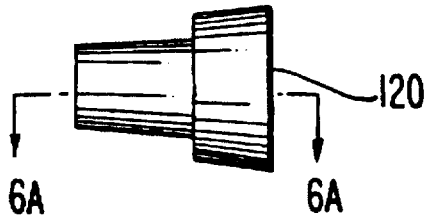
FIG. 6 is the pinion seal used in the hand pump sprayer of FIG. 1.
Figure 6A:
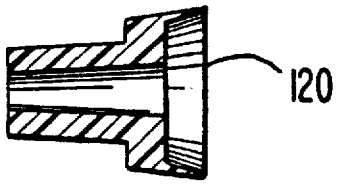
FIG. 6A is a section through 6A—6A view of the pinion seal of FIG. 6.
Figure 7:
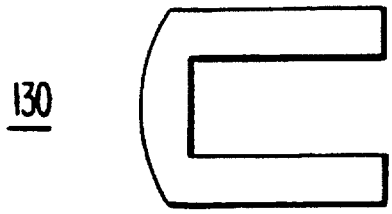
FIG. 7 is a side view of the U-shaped retainer used in the hand pump sprayer of FIG. 1.
Figure 8A:
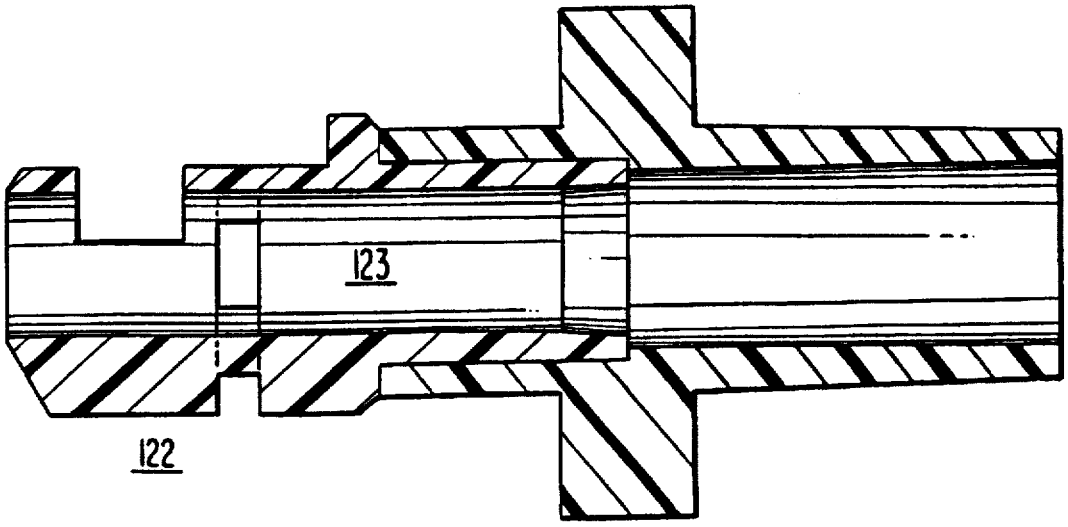
FIG. 8A is a sectional view of FIG. 8 through 8A—8A.
Figure 8:
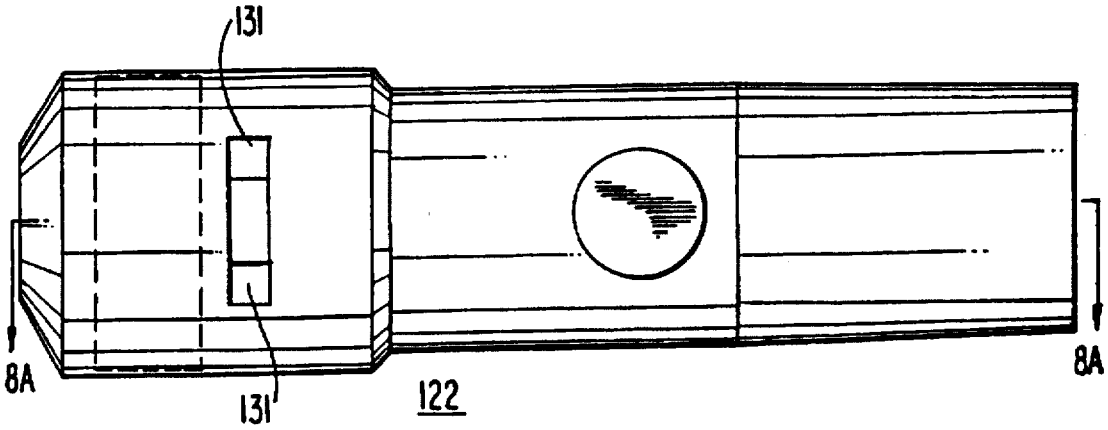
FIG. 8 is a side view of the plunger used in the hand pump sprayer of FIG. 1.
Figure 9:
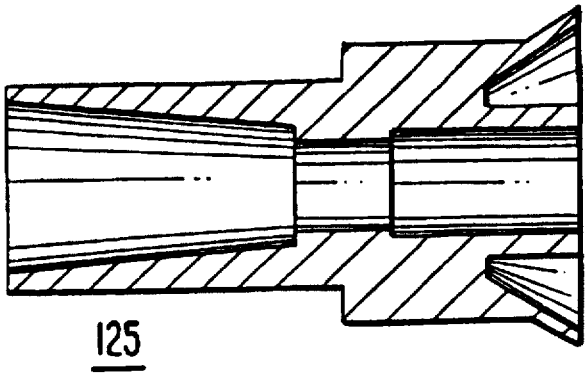
FIG. 9 is a sectional view of the plunger seal used in the hand pump sprayer of FIG. 1.
Figure 10:
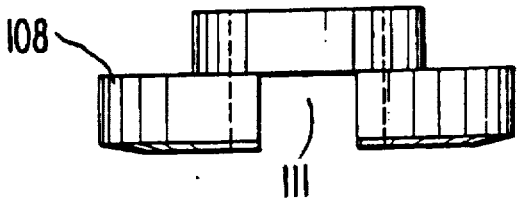
FIG. 10 is a side view of the rack positioner of the hand pump sprayer of FIG. 1.
Figure 10A:
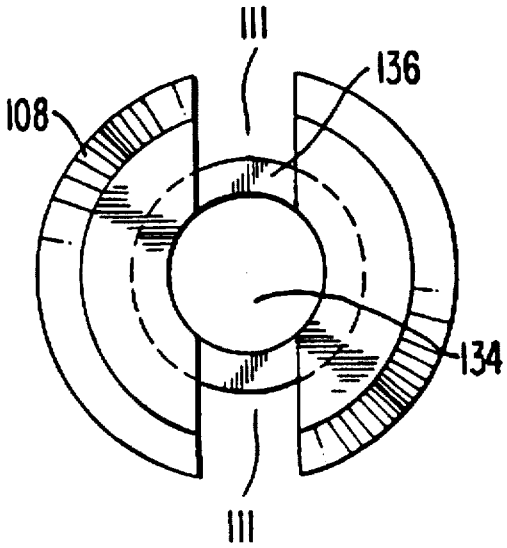
FIG. 10A is a front view of the rack positioner.

Referring to FIGS. 1 to 10, a hand pump sprayer 100 is provided with trigger 112 which is pivotly connected to pump housing 150 through pin 140. A nozzle 102 having angular outlets 103 for discharging fluid from the hand pump sprayer in colliding streams is provided, preferably as described in U.S. Pat. No. 5,088,649 (Hanson). A rack 104 having rack teeth 105 is held in place by rack positioner 108. The rack 104 can be disengaged by rotating rack positioner 108 about boss 136 in rack retainer 110 until rack positioner slot 111 is aligned with rack 104. Rack 104 then slides into slot 111. In such position, the nozzle 102 will not rotate. Rack retainer 110 is mounted to trigger 112 and holds the rack positioner 108 and the rack 104 in place. It should be understood that alternatively the rack 104 could be integral with the trigger 112 e.g., molded or the like. Nozzle drive gear preferably pinion assembly 106 having pinion teeth 107 is provided for engagement with rack 104. Pinion assembly 106 is axially aligned with nozzle 102. As best seen in FIG. 4 and FIG. 5A, nozzle 102 is snap mounted into nozzle housing 116 in pinion assembly 106. Pinion assembly fluid passageway 114 is provided through the middle of the generally cylindrically pinion assembly 106 and brings fluid to the nozzle 102. As best seen in FIG. 4 and FIG. 6, pinion seal 120 is provided for mounting in the inlet end of the pinion assembly 106 in bore 119. As shown in FIG. 4 and FIG. 8A pinion assembly 106 slides into generally cylindrical plunger 122 through plunger hollow 123. Pinion assembly 106 is held in place by U-shaped pinion retainer 130 which slides through holes 131 in plunger 122 and bares against circular groove 118 in the outside wall of pinion assembly 106 to thereby securely interconnect the pinion assembly 106 to the plunger 122. Adjacent the pinion assembly 106 within the plunger hollow 123 is pinion assembly seal 120. The seal 120 prevents fluid leakage around the pinion assembly 106. Adjacent the pinion assembly seal 120 is check valve spring retainer 124 for receipt and retention of spring 126. A conventional check valve 128 is located within plunger hollow 123 adjacent to spring 126. Adjacent to plunger 122 is plunger seal 125 to present leakage from the plunger 122. The fluid passageway 132 extends through the entire assembly and brings fluid to pinion fluid passageway 114 from the reservoir. Fluid passageway 132 is then interconnected in a conventional manner to the reservoir through a dipstick or the like not shown.

In operation the liquid is pumped by the action of the trigger and plunger. Liquid is brought from the reservoir to the delivery passageway in a conventional manner, see for example, U.S. Pat. Nos. 4,646,969 or 3,927,834. As the trigger is pulled the rack 104 moves back and forth simultaneously with the pulling of the trigger 112 and rotates the pinion assembly 106 which in turn simultaneously rotates the nozzle located in the nozzle housing 116 in the pinion assembly 106. As a result, liquid is drawn from the reservoir through the delivery passageway which is composed of pinion assembly fluid passageway 114 and fluid passageway 132 expelled under pressure to the atmosphere through the nozzle outlets in colliding streams. Simultaneously with the discharge of the fluid from the nozzle, the nozzle rotates through an angle of 90° to 360°, preferably from 180° to 360° and most preferably 270° or more. The resulting fluid preferably a viscous liquid having a viscosity of 60 to 100 cps, most preferably from 60 to 85 cps is discharged in a fine mist in a circular pattern. When the rack is moved back and forth the pinion assembly 106 is rotated by the rack and rotates the nozzle 102 which is snap fitted into the nozzle housing 116. The rack rotates the pinion assembly 106 and the nozzle 102 about an axis X of rotation through the center of the discharge end of the nozzle through an angle of rotation of from 90° to 360° preferably from 180° to 360° and most preferably 270° or more. It should be understood that alternative methods of rotating the nozzle are contemplated by the invention. As shown in the alternative embodiment shown in FIGS. 11 to 13, the nozzle drive gear is driven indirectly by the trigger through several interconnected gears.

Referring to the FIGS. 11 to 13, hand pump sprayer 10 is provided with a trigger 12 which is pivotly connected to pump housing 14 through a pivot preferably pin 15. A nozzle 18 is rotatably mounted to the hand pump sprayer for rotation about an axis of rotation X through the center of the nozzle. Nozzle 18 preferably has two nozzle outlets 64. Optionally a single nozzle outlet which is offset from the axis of rotation can be used. Desirably the nozzle outlets 64 provide colliding streams of fluid intersecting at one point outside the nozzle such as described more fully in U.S. Pat. No. 5,088,649 which is herein incorporated by reference. A hollow rod 34 interconnects nozzle 18 with fluid passageway 66 through fluid passageway housing 68. The hollow rod 34 has a cylindrical nozzle seal 20 having a blunt nose 22 at the nozzle end of a hollow rod 34. The blunt nose 22 forms a seal with nozzle 18 to prevent fluid from leaking from the hollow rod 34 during dispensing. Hollow rod 34 is interconnected with the fluid passageway of the pump sprayer to complete the delivery passageway of the pump sprayer and to deliver fluid to the nozzle 18 from the reservoir. Integral with hollow rod 34 is seal ring 38. The nozzle 18 is rotated about the axis of rotation X preferably by a convenient gearing arrangement interconnected to the trigger 12 so that the back and forth trigger movement is translated to rotational movement of the nozzle 18. Simultaneously with the delivery of pressurized fluid to the atmosphere, the nozzle 18 is rotated about the axis X through the middle of the nozzle 18.

A nozzle drive gear such as bevel gear 24 is interconnected with nozzle 18. Integral with the nozzle drive gear 24 is segmented snap ring 28 having segments 30 and threaded concentric hub 32 and slotted collar 31. Nozzle 18 contains internal threads and is screwed onto threaded concentric hub 32 for rotatable movement as nozzle drive gear 24 rotates. The threads are not shown in the Figures. A gear platform 58 having a passageway 40 is provided. Fluid from the pressurized reservoir flows through passageway 40 which is interconnected with the fluid passageway 66. Plunger 60 seals passageway 40 from liquid leaks. Mounting ring 26 is mounted to gear platform 58 concentrically to the outlet of passageway 40. Mounting ring 54 is mounted to the side of gear platform 58 substantially perpendicularly to mounting ring 26. The mounting rings 26 and 54 preferably are integral with gear platform 58. Nozzle drive gear 24 is mounted to mounting ring 26 through a snap connection through segmented snap ring 28. Hollow rod 34 fits through the slot 33 in hub 32 and slotted collar 31 and then through passageway 40 to interconnect with fluid passageway 66.

A second bevel gear 42 which is identical to nozzle drive gear 24 is provided and interconnected at a right angle to nozzle drive gear 24. Teeth 25 of gear 24 and teeth 43 of gear 42 are operatively intermeshed so that movement of gear 42 is translated into rotational movement of gear 24. Gear 42 is mounted to the hand pump sprayer 10 through gear platform 58 through mounting ring 54 in the same manner previously described for gear 24. Gear 42 includes a segmented snap ring (not shown) having segments identical to those shown in gear 24. In the same manner as gear 24 is mounted to mounting ring 26, gear 42 is mounted to mounting ring 54 for snap engagement therewith. Integral with gear 42, are slotted collar 44 and slotted threaded concentric hub 46. Slot 47 extends through concentric hub 46 and slotted collar 44. A pinion assembly 48 consisting of a pinion 49 mounted to a cylindrical collar 52 terminating in arms 50 is provided. The pinion 49 snugly fits into slot 47 in slotted collar 44 and threaded concentric hub 46. Arms 50 are received in flush relationship with slotted collar 44 so that the arms 50 slide through the slot 47 and snugly engage in slotted collar 44. Pinion retainer ring 56 is provided to hold pinion assembly in place. Gear 42 rotates in tandem with pinion 49 and is moved by the action of arms 50 against collar 44 to rotate gear 42.

A rack preferably an arcuate (curved) rack 70 is attached to trigger 12 for rotational engagement of pinion 49 upon the movement back and forth of the trigger 12 during spraying. In operation, the trigger 12 is pulled by the user. The liquid is traveling from the reservoir and pressurized as is conventional in hand pump sprayers. See, for example, U.S. Pat. No. 3,927,834. As the trigger 12 is pulled back and forth the rack 70 rotates pinion 49 which rotates arm 50 which in turn rotates gear 42 which rotates nozzle drive gear 24 which in turn rotates the nozzle simultaneously as the fluid is ejected to the atmosphere. The fluid preferably a viscous liquid is then dispensed in fine droplets in a circular spray pattern.

The nozzle rotation mechanism can be easily disengaged by the user. To disengage the rotation of the nozzle 18, the retainer ring 56 is loosened or removed. Arms 50 of pinion assembly 48 are pulled to move the pinion 49 from engagement with gear rack 70. As a result, the nozzle 18 will no longer rotate.

In another aspect of the invention, a manual pump sprayer such as a hand pump or finger pump sprayer is provided which has an adjustable delivery pressure system.

According to the invention, the adjustable delivery pressure system includes a pressure adjustment assembly which allows adjustment of the pressure within the delivery passageway between a preselected pressure range. This pressure range is selected depending on the vicosity of the fluid to be pumped and the degree of atomization required. The pressure adjustment assembly includes an adjustable biasing member and a pressure chamber check valve. The adjustable biasing member preferably a spring provides a force on the pressure chamber check valve in a direction opposite to the flow of liquid from the reservoir to the atmosphere. By compressing the spring, preferably through a spring retainer, through a variable range of compressions, the force on the check valve can be varied. As a result, the amount of pressure reached in the delivery passageway, can be adjusted through a preselected range of pressures.

Figure 14:
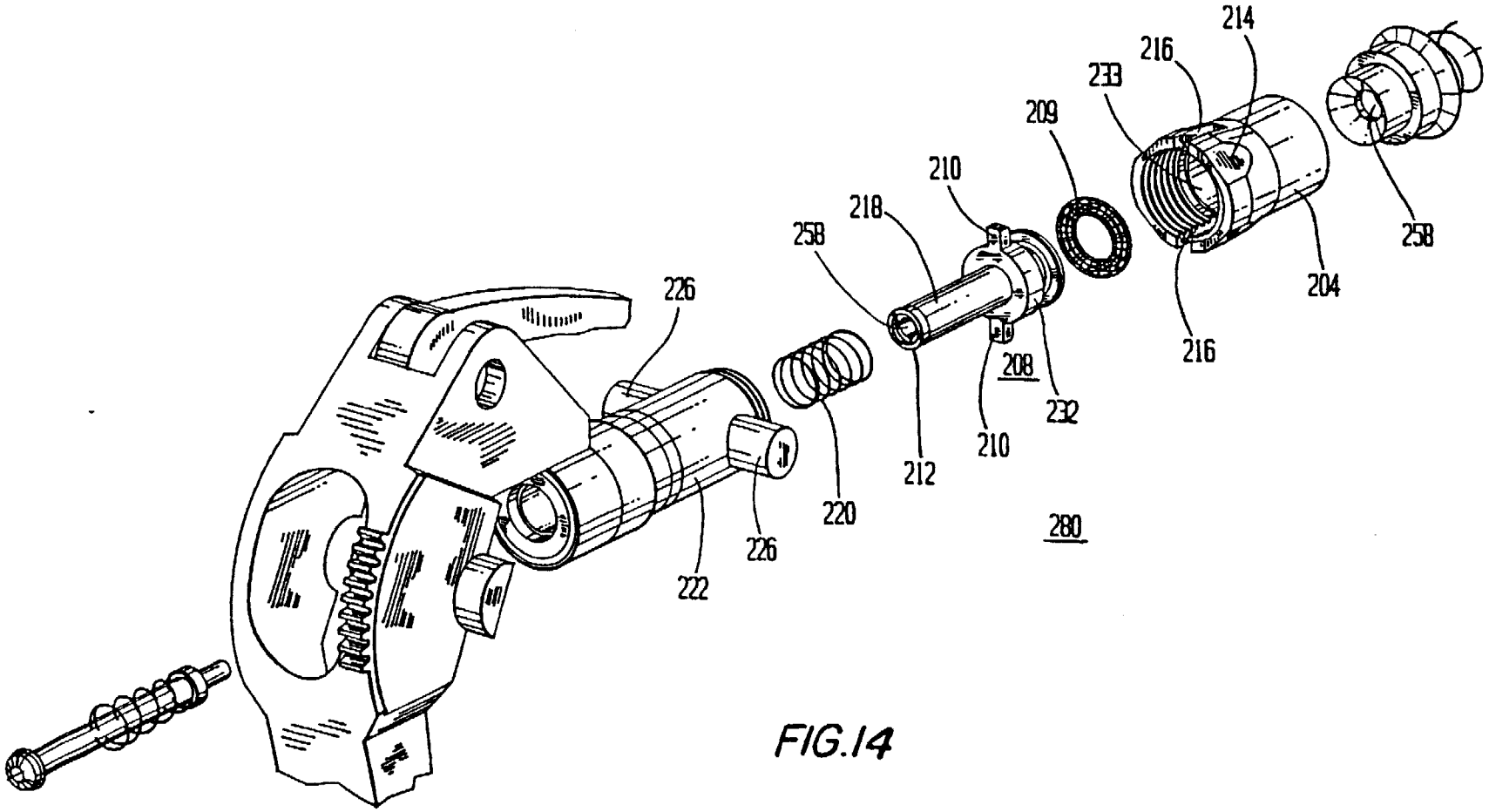
FIG. 14 is a partial exploded perspective view of an alternative embodiment of the invention.
Figure 15:
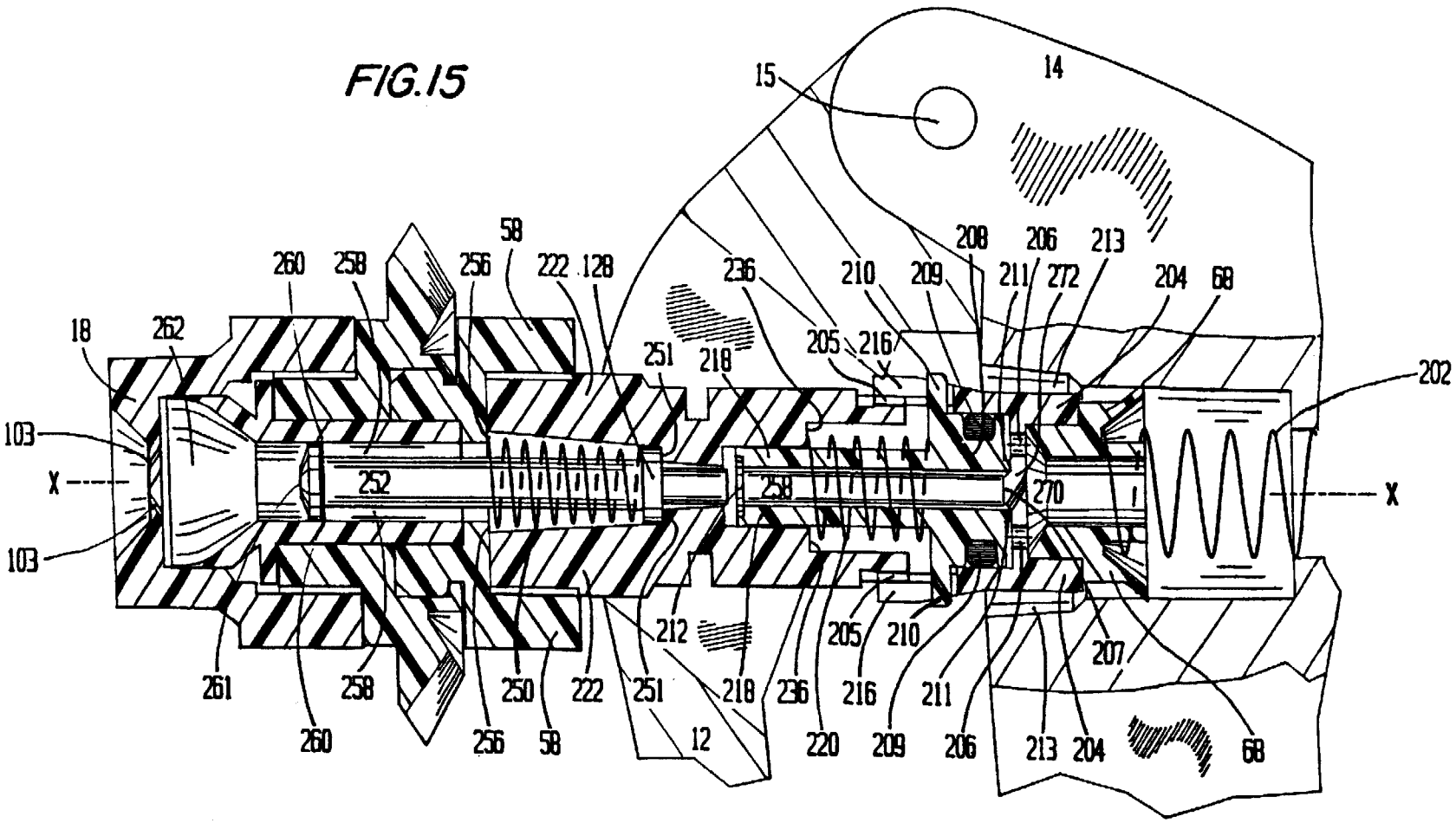
FIG. 15 is a sectional side view of the embodiment of FIG. 14.

As best seen in FIGS. 14–15, a manual pump sprayer preferably, a hand pump sprayer having an adjustable pressure assembly 280 is provided. Alternatively, the adjustable pressure assembly according to the invention, can be installed in a finger pump of FIG. 16. Preferably, the adjustable pressure assembly is installed in a rotating nozzle dispenser. Optionally, it can be installed in a non-rotating spray dispenser such as in U.S. Pat. Nos. 5,088,649 or 3,927,834. Assembly 280 includes a check valve retainer 204. Check valve retainer 204 preferrably has a generally cylindrical shape. A cylindrical inlet channel 270 is provided at the inlet side of check valve retainer 204 for receipt of pressurized liquid from the hand pump reservoir. Channel 270 is separated from the fluid passageway 258 through the hand pump sprayer 280 by partition 272 which includes an opening, desirably holes, preferably a plurality of symmetrically spaced holes, most preferrably four holes 206. At the outlet side of partition 272, is a projection 207 centrally located on partition 272. Check valve retainer cavity 233 extends from partition 272 to the outlet of the check valve retainer 204. Slots 216 are provided at the outlet side of check valve retainer 204. Adjustment flats 214 are located on check valve retainer 204, preferably four (4) adjustment flats 214 are provided. A check valve 208 having a hollow conduit 218 is provided. Conduit 218 provides a part of fluid passageway 258 and extends through the entire length of check valve 208. Check valve 208 includes a disk 232 integral with conduit 218. The disk 232 has projecting ears 210 which when the adjustable pressure assembly is in place in the hand pump sprayer slides into slots 216 in check valve retainer 204. Preferably, o-ring 209, high pressure seal 211 and low pressure seal 212 are provided to prevent fluid leakage. Spring 220, having a predetermined spring strength, is provided for mounting on hollow conduit 218. The spring strength is pre-selected so that a pre-determined range of pressures can be achieved in the manual sprayer for a particular viscosity or range of viscosities. A spring retainer 222 having projections preferably two projections 226 is provided for adjusting the compression of spring 220. Spring retainer 222 is hollow and provides a portion of fluid passageway 258. A circular ledge 236 is provided within the hollow interior of spring retainer 222 for compressing of spring 220.

When installed in a manual pump sprayer, check valve retainer 204 is inserted along fluid passageway 258 in fluid communication with pressurized liquid delivered from the manual pump reservoir to passageway 270. Check valve 208 which includes o-ring seal 209 slides into retainer cavity 233 in check valve retainer 204. Priming ears 210 are received by slots 216 in check valve retainer 204. Projection 207 blocks off fluid flow through hollow conduit 218. Spring 220 is mounted on hollow conduit 218 and sits on disk 232. Spring retainer 222 is threadedly (threads 205) engaged with check valve retainer 204. Spring 220 can be selectively compressed depending on how tightly spring retainer 222 and check valve retainer 204 are engaged. When assembled, spring retainer 222 adjustably compresses spring 220 between disk 232 in check valve 208 and ledge 236 in spring retainer 222. As a result, a variable force is applied to check valve 208 which must be overcome by fluid entering channel 270 from the reservoir of the hand pump sprayer. Depending on how tightly spring retainer 222 is threadedly connected to check valve retainer 204, the spring 220 will be more or less compressed and as a result a variable force can be applied to the check valve 208.

In operation, fluid is delivered from the reservoir to channel 270. The central passageway in check valve 208 is blocked off by projection 207. Fluid holes 206 are provided in partition 272. When sufficient pressure has been reached at the entrance to holes 206, the check valve 208 is moved off of projection 207 and fluid then flows through hollow conduit 218. The amount of pressure can be adjusted by tightening or loosening the threaded engagement between spring retainer 222 and check valve 204. Desirably, the spring compression can be adjusted by applying a wrench to adjustment flats 214.

Ears 210 contact the walls of recess 213 at the end of each pump stroke to facilitate priming on the initial activation of the manual pump sprayer. Thus, at the end of each stroke, ears 210 move check valve 208 off of projection 207 to allow priming.

According to another aspect of the invention an exit orifice purge system is provided. The exit orifice purge system can be used in a rotating nozzle or non-rotating nozzle dispensing system. In this aspect of the invention, a negative pressure differential is created between the delivery passageway and the atmosphere each time the actuator is released so that the pressure in the delivery passageway is lower than the atmospheric pressure. As a result, there is a negative pressure differential between the delivery passageway and the atmosphere which draws any liquid remaining in manual pump spray dispenser orifices back into the dispenser.

As best seen in FIGS. 14 to 15, a check valve 128 is located in fluid passageway 258. Rod 252 is located in fluid passageway 258 on the outlet side of the check valve 128. Rod 252 is attached to check valve 128 and moves in tandem therewith. A spring 250 is mounted on rod 252. A spring seat 256 is provided on the interior of gear platform 58 for engagement and compression of spring 250 upon the movement of check valve 128. Rod 252 terminates in a lip seal 260 which includes a blunt nose top 261. Fluid passageway 258 into an exit chamber 262 which is preferably integral therewith and which has a larger diameter than fluid passageway 258. Exit chamber 262 transmits fluid, preferably pressurized liquid, to the outlet orifices 103 in nozzle 18.

In operation, pressurized fluid is brought from the reservoir of the manual pump sprayer. The pressurized fluid, preferably a viscous liquid for example, viscous vegetable oil having a viscosity of 60 cps or greater is brought from the reservoir. The pressurized fluid moves check valve 128 off of valve seat 251 and begins to compress spring 250. Once the check valve 128 is moved, the pressurized fluid flows through fluid passageway 258 until central passageway 258 is filled. Lip seal 260 attached to rod 252 retains the fluid within passageway 258. When passageway 258 is filled with the pressurized fluid, spring 250 is further compressed. Check valve 128 then moves rod 252 and seal 260 along fluid passageway 258 until the lip seal 260 enters into exit chamber 262. As a result, the lip seal 260 is disengaged and pressurized fluid flows from fluid passageway 258 into exit chamber 262 to orifices 103 and is expelled to the atmosphere.

After the fluid has been expelled to the atmosphere, the exit orifice purge system operates to draw back fluid from the orifices 103 to reduce any dripping from sprayer. The reservoir is pressurized by a pulling on trigger 12. Each time the trigger is pulled, the check valve 128 is moved as described above. Upon complete travel of trigger 12, pressure rapidly diminishes in central passageway 258. Spring 250 expands to its original position forcing check valve 128 to return to seat 251. At the same time lip seal 260 which is connected to check valve 128 by rod 252 returns to its original position in fluid passageway 258. The movement of lip seal 260 into central passageway 258 creates negative pressure in exit chamber 262. External pressure outside nozzle 18 and orifices 103 provides pressure which clears orifices 103 by pushing liquid remaining in orifices 103 back into exit chamber 262. Hence, unintended dripping and discharge from nozzle 18 is greatly reduced.

The foregoing is considered as illustrative only to the principles of the invention. Further, since numerous changes and modifications will occur to those skilled in the art, it is not desired to limit the invention to the exact construction and operation shown and described above, and accordingly all suitable modifications and equivalents may be resorted to, falling within the scope of the invention.

I claim:

1. A manual pump spray dispenser wherein liquid is brought from a reservoir, pressurized to a predetermined pressure, flows through a delivery passageway and is dispensed to the atmosphere comprising:

a nozzle having a nozzle inlet, nozzle outlet means, and a nozzle center;

said nozzle in fluid communication with said delivery passageway;

pressure adjustment means to adjust said predetermined pressure between a pre-selected range of pressures;

said pressure adjustment means being accessible from the exterior of said manual pump spray dispenser for adjustment of the pressure without disassembly of the spray dispenser.

2. A manual pump spray dispenser wherein liquid is brought from a reservoir, pressurized to a predetermined pressure, flows through a delivery passageway and is dispensed to the atmosphere comprising:

a nozzle having a nozzle inlet, nozzle outlet means, and a nozzle center;

said nozzle in fluid communication with said delivery passageway;

pressure adjustment means to adjust said predetermined pressure between a pre-selected range of pressures;

said pressure adjustment means including a pressure chamber check valve having an inlet side and an outlet side; and an adjustable biasing means to supply force on said pressure chamber check valve in a direction opposite to the flow of liquid from the reservoir to the atmosphere whereby the pressure in said delivery passageway can be varied.

3. The spray dispenser according to claim 2 wherein said adjustable biasing means includes a spring having a pre-selected compression range, said spring bearing against the outlet side of said pressure chamber check valve;

compression means to selectively compress said spring through said compression range so that the force exerted by said spring against said outlet side of said pressure chamber check valve can be varied.

4. The spray dispenser according to claim 2 further comprising:

said nozzle rotatably mounted to said spray dispenser for rotation of said nozzle from 90° to 360° about an axis X of rotation through the nozzle center;

an actuator interconnected to said nozzle to rotate said nozzle around said axis of rotation simultaneously with the dispensing of the liquid to the atmosphere, upon the activation of said actuator.

5. The spray dispenser according to claim 4 further comprising:

means for creating a negative pressure differential between said nozzle outlet means and the atmosphere after the liquid is dispensed to the atmosphere so that liquid remaining in the nozzle outlet is drawn back within said delivery passageway.

6. The spray dispenser according to claim 5 wherein said means for creating a negative pressure includes:

a rod having an exit end and inlet end, said rod slidable mounted within said delivery passageway;

an exit chamber having a larger cross sectional area then said delivery passageway, said exit chamber in fluid communication with said delivery passage and said nozzle;

seal means located on said rod exit end;

said seal means having a sealed position and an unsealed position;

an exit check valve for selectively introducing liquid from said delivery passageway to said nozzle outlet;

said exit check valve operatively interconnected to said rod to move said rod exit end into said exit chamber and move said seal means into the unsealed position when the liquid from said reservoir has filled delivery passageway;

means to pressurize said delivery passageway to a predetermined pressure prior to moving said seal means into the unsealed position;

return means for returning said seal means to the sealed position after said liquid is dispensed to the atmosphere.

7. The spray dispenser according to claim 2 further comprising:

means for creating a negative pressure differential between said nozzle outlet means and the atmosphere after the liquid is dispensed to the atmosphere so that liquid remaining in the nozzle outlet is drawn back within said delivery passageway.

8. The spray dispenser according to claim 2 further comprising:

a rod having an exit end and inlet end, said rod slidable mounted within said delivery passageway;

an exit chamber having a larger cross sectional area then said delivery passageway, said exit chamber in fluid communication with said delivery passage and said nozzle;

seal means located on said rod exit end;

said seal means having a sealed position and an unsealed position;

an exit check valve for selectively introducing liquid from said delivery passageway to said nozzle outlet;

said exit check valve operatively interconnected to said rod to move said rod exit end into said exit chamber and move said seal means into the unsealed position when the liquid from said reservoir has filled delivery passageway;

means to pressurize said delivery passageway to a predetermined pressure prior to moving said seal means into the unsealed position;

return means for returning said seal means to the sealed position after said liquid is dispensed to the atmosphere.

9. A spray dispenser according to claims 6 or 8 wherein:

said return means is a spring compressed by said exit check valve when said seal means has moved into the unsealed position.

10. The spray dispenser according to any one of claims 2 or 4 wherein said spray dispenser is a trigger sprayer.

11. The spray dispenser according to any one of claims 2 or 4 wherein said spray dispenser is a finger pump sprayer.

12. The spray dispenser according to any one of claims 2 or 4 wherein said nozzle outlet means includes a first and second outlet.

* * * * *